United States Patent [19]

Bleckmann, deceased et al.

[11] 4,251,907

[45] Feb. 24, 1981

[54] METHOD FOR THE MANUFACTURE OF THIN-WALLED METAL TUBES

[76] Inventors: Richard Bleckmann, deceased, late of Salzburg, Austria; by Anneliese Bleckmann, heir, Imbergstrasse 24, A-5010 Salzburg, Austria

[21] Appl. No.: 922,664

[22] Filed: Jul. 7, 1978

[30] Foreign Application Priority Data

Jul. 8, 1977 [DE] Fed. Rep. of Germany ..... 2731027

[51] Int. Cl.[3] ..... B23P 19/00

[52] U.S. Cl. ..... 29/456; 29/526 R; 138/171; 138/172; 285/252; 228/147; 228/151

[58] Field of Search ..... 29/456, 526 R; 228/147, 228/151; 285/252, 242, 253; 138/172, 171

[56] References Cited

U.S. PATENT DOCUMENTS

| | | | |
|---|---|---|---|
| 886,616 | 5/1908 | Long | 228/151 |
| 1,286,388 | 12/1918 | Mulconroy | 285/253 X |
| 1,472,518 | 10/1923 | Gillette et al. | 29/456 UX |
| 1,978,235 | 10/1934 | Summers | 228/147 |
| 2,196,708 | 4/1940 | Reid | 138/172 X |
| 2,208,706 | 7/1940 | Spencer | 285/253 |
| 2,522,684 | 9/1950 | Mitchell | 285/253 |

FOREIGN PATENT DOCUMENTS 524552 5/1931 Fed. Rep. of Germany .

*Primary Examiner*—Charlie T. Moon
*Attorney, Agent, or Firm*—Fleit & Jacobson

[57] ABSTRACT

A method for manufacturing thin-walled metal tubes and structures utilizing thin-walled metal tubes. A continuous metal tube is formed by passing longitudinally-extending metal tape through forming tools which bend the lateral edges of the metal tape towards each other to form the tube. A continuous wire or tape is wrapped in the form of a helix around the tube. The wrapped tube is heated to melt soldering material that joins the lateral edges of the folded metal tape to each other. The soldering material can take the form of a separate sheet positioned between the wire or tape and the folded tube, a coating applied to the wire or tape, or a coating applied to a surface of the metal tape. The thin-walled tube is attached to other members to form composite structures.

4 Claims, 4 Drawing Figures

METHOD FOR THE MANUFACTURE OF THIN-WALLED METAL TUBES

BACKGROUND OF THE INVENTION

1. Field of the Invention

The invention is concerned with a method for the manufacture of thin-walled metal tubes, in particular, the manufacture of tubes for liquefiers of freezing devices, of pipe-lines for brake fluid in automobiles, of casings for tubular electric heaters and of tubes for air heaters with low-pressure steam. In accordance with this method, a metal tape is bent, during its continuous passage through suitable forming tools, at a right angle to its longitudinal axis, and the marginal areas of the tape joined together.

2. Description of the Prior Art

The manufacture of metal tubes by having a metal tape run continuously through grooved rolls that form a split tube is known. Subsequently, the edges of the tape are welded together. If there are not any other technical reasons for a relatively considerable thickness of the wall of the tube and, therefore, for the use of much material, the thickness of the wall of the tube, and thereby the thickness of the metal tape used as the raw material, is determined by the radial pressure that will occur in use. The axial load of the tube is generally non-critical, i.e., the demand made upon the strength of the tube in the case of internal excess pressure in the lengthwise direction of the tube is only half the demand in the tangential direction.

When the split tube is manufactured, the longitudinal edges of the tubes must be pressed against one another with the aid of grooved rolls, with such force that the contact will be a permanent one, i.e., splitting open of the split tube is to be prevented. This is possible only when the tape is rolled-on-edge. Thus, the tape must be larger than the circumference of the tube to be manufactured, so as to make up for the reduction of the circumference due to the rolling-on-edges of the tube. The degree of rolling-on-edge amounts, in the case of tapes of unalloyed steel, to some 5%. Despite the rolling-on-edge, there appears, due to the action of heat during soldering, modifications of the soldered joint which affect the quality of the soldering adversely. Without any rolling-on-edge, a relatively wide split will appear, e.g., of a width of 0.2 to 0.3 mm in the case of a tape of unalloyed steel having a thickness of 0.5 mm. A split of this magnitude, however does not have the capillary effect required to draw in any solder.

In addition, the use of seamless tubes is known. With seamless tubes, a copper tube is manufactured by the extrusion of a tube of desired diameter and desired wall thickness. These tubes are relatively expensive. In accordance with the method of the present invention, a saving of more than 30% can be achieved in comparison with the cost of seamless tubes, while the properties of the tubes in accordance with the invention are equal or superior.

Furthermore, tubes manufactured in accordance with the so-called Bundy method are known. In accordance with this method, an unalloyed steel tape which is approximately twice as wide as the circumference of the tube to be manufactured, is copper-plated by galvanization.

The steel tape is then round in the form of a double-spiral, i.e., the thickness of the wall of the manufactured tube amounts to twice the thickness of the original tape.

Subsequently, soldering in a soldering furnace takes place. The copper that has been applied by electro-plating is used as soldering material. In the subsequent step of the operation, in accordance with this method, the tube is then, in general, cold-tightened and, possibly, soft-annealed once more. The advantage of the Bundy-tubes as manufactured by this method, when compared to welded tubes, is to be found in their absolute tightness and, thereby, safety. It is true, however, that these tubes are relatively expensive, due to the galvanic copper-plating and the expensive manufacturing process.

In addition, there is the disadvantage that the thickness of the wall of the completed tube amounts to twice the thickness of the original steel tape, so that it is not possible to produce tubes with very thin walls.

SUMMARY OF THE INVENTION

Accordingly, the invention is based on solving the problem of proposing a new method for the manufacture of thin-walled metal tubes in which a high degree of safety as to the density of the tube and the possibility of making higher demands on the resistance of the tube to radial stress are achieved. In addition, particular advantages—as described in the following—may be achieved, depending on the use for which the tube is intended.

The features of the new method may be recognized from the characteristics of the Principal Claim. Preferred forms of the embodiment of the invention have been described in the Sub-Claims.

A method is known for enlarging the surface of a completed tube, so as to improve the heat transfer, by means of ribs that are rolled-up upright on a tube, for example, heaters with ribbed pipes for space heating, in which a tape of unalloyed steel is rolled up upright on a seamless or welded pipe of unalloyed steel. An improvement of the heat transfer is achieved in those cases only when one sees to it that an appropriate heat transfer will take place from the tube to the rolled-on tape, i.e., appropriate soldering or welding operations are required.

The method in accordance with the invention differs from those manufacturing methods, inasmuch as a wire or tape in helical form is wrapped around the semi-manufactured product, i.e., before the marginal areas of the tape being used as raw material are joined together. By means of the wrapping-around of the tape or wire in helical form with a certain initial tension, it is possible to achieve a well-defined split seam, without the "on-edge-rolling" of the tape by the grooved rolls. The split-seam has the capillary effect required for soldering. It will now be possible, in the case of tapes of unalloyed steel, before the rolling-on of the wire-helix to apply a thin copper foil having, for example, a width of 3 mm and a thickness of 0.1 mm. The copper foil used as solder is held in place by the wire-helix. When the semi-manufactured product is heated, for example, in a soldering furnace until the copper foil melts, the copper foil is pulled into the split, due to the capillary effect, in such a way that, after cooling, the tube is closed cleanly and solidly. The essential advantages of this manufactured method are, therefore, to be found in the achievement of an exact capillary slit, in the exact dosage of the soldering material, and in the fact that the soldering material is firmly held by the wire-coil at the desired spot. It is ensured further that no undesirable modifications in the soldering slit will occur due to the action of heat in the soldering furnace.

Now, it is possible, when one intends to manufacture thin-walled tubes which are not exposed to any particular internal pressure, to wind-off the helix after the closing of the split and again to wind it up on a new section of the tube. It is a pre-requisite for this step that a helical wire is used that does not combine with the respective solder. For example, in the manufacture of a tube of unalloyed steel with copper as solder, a coil of stainless steel is used. But, in many cases of the application of the method, it will be advantageous to leave the rolled-on helix on the tube. In the latter cases, one will also, generally, see to it that the helix is soldered onto the tube at the same time as the slit is closed, during heating in the soldering furnace. Tubes manufactured in this way will have in the radial direction a strength that is twice the strength of the axial direction, provided the dimensions have been chosen appropriately, i.e., the diameter and the radient of the rolled-on coil-wire have been selected properly. Accordingly, while the weight of material per unit of length is the same, the radial pressure-load of a tube manufactured in this way is considerably higher than that of a conventional tube. But, beyond these advantages, there are a number of additional ones for special fields of application of the method.

When the tube is used as a cover of a tubular heater, the heat-transmitting surfaces can be doubled without any further difficulties, by means of an appropriate pitch of the coils. This means that, in the case of a comparable nominal load, the tubular heater can be shortened by at least one third. Even if the cost reduction, which is of considerable importance, is disregarded, it must be taken into consideration that the space for the tubular heater is limited. When the space is fully utilized, as in the case of most household utensils, a device manufactured in accordance with the present invention can be operated at higher nominal performances, so that proportionately shorter periods of time are required to heat up the space.

Up to this time, the fastening of tubes or of tubular heaters to sheet-metal holders, to pipes for the passage of water, or to other shaped bodies has been a problem. Frequently, aluminum or aluminum alloys are used, because of their relatively low price and of their excellent heat conductivity. In the case of these materials, soldering is generally not applicable. Therefore, electric welding with very high current intensities is required, inasmuch as the entire length of the tube is supposed to rest against the sheet-metal holder. Since the welding current flows through the cover of the tube, there is also the risk of the cover of the tube being damaged, i.e., welded-on. In the case of tubes manufactured in accordance with the invention, the rolled-on wire helix forms a great number of welds that are arranged at a distance from one another, so that, practially, point-seam welding will be achieved. The welding current flows predominantly through the helix, so that there is minimal or no damage of the cover-tube.

An additional possibility of fastening the tube consists in pressing the tube in a power press onto the sheet-metal holder or onto the shaped body. The helical sections that lie against it, penetrate, in this case, vertically into the material of the sheet-metal holder. During this process, the material has to give way laterally, i.e., in an axial direction of the tube, and is forced into the largest cross section of the adjoining wire helix. In this way, an anchoring effect is achieved. The tubes that have been pressed on cannot be separated from the sheetmetal holder, even when very considerable force is used. The helix that has been soldered on can be used for fastening in another way, also, since—after all—we have to do practically with a tube with a soldered-on thread. When a tube of this type is to be fastened, e.g., in the wall of a container, then only two special nuts will be necessary that have an internal thread that fits the soldered-on helix. When at least one of those nuts has a conical shape, then it will be possible to place a rubber ring inside the cones, said rubber ring being enclosed by the tube and by the wall of the container and making a sealed-off passing-through possible. When two tubes of this type are to be joined together, it can be done with the aid of a sleeve with a continuous thread. The tubes to be joined together will have to be rotated against one another. If this is not possible, then, in each case, one tube with a clockwise helix will have to be joined to a tube with a counterclockwise helix by means of a sleeve with left-hand thread and right-hand thread, respectively.

The following examples are presented further to explain the method in accordance with the invention.

EXAMPLE 1

A tape made of copper that contains no oxygen and has a thickness of 0.5 mm is bent with the aid of grooved rolls, so as to become a split tube with a diameter of 8 mm. A copper wire having a diameter of 1 mm is wound in the shape of a helix onto the split tube; the pitch amounting to 2 mm. At the same time, as the winding onto the tube, a strip of copper-solder having a width of 3 mm and a thickness of 0.1 mm is inserted between the helix and the split tube. Subsequently, the tube is heated in a soldering furnace through which it passes, preferably continuously. During this process, the melting copper solder flows into the slit of the split tube, due to capillary action, and closes it. At the same time, and in addition, the helix is soldered unto the tube. Without the wire-helix, the tube would have a surface of 250 $mm^2$ per cm of its length. The surface of the rolled-on wire amounts to 450 $mm^2$ per cm of length of the tube. On the assumption of a width of the solder of 0.2 mm, 60 $mm^2$ will have to be deducted for the soldering joint. Consequently, the surface of the tube is enlarged from 250 $mm^2$ to 640 $mm^2$, by means of the helix.

An additional enlargement of the surface may be achieved by rolling the rolled-on wire flat while rotating the tube.

EXAMPLE 2

Liquefiers, viz. condensers of refrigerators, consist of an unalloyed steel tube which is bent so as to have a meander-shape, and on which, for the purpose of enlarging the surface, wires or sheet-metal ribs of unalloyed steel, arranged a distance from one another, are mounted across the meander-shaped rolls, in a heat-conducting manner. The entire structure is hot-galvanized and then varnished, so as to protect it from corrosion. In the interior, an operating pressure of no more than approximately 16 atmospheres absolute pressure prevails, and the dimensions of the tube must be designed accordingly.

In accordance with the invention, a type of unalloyed steel having a thickness of 0.5 mm is bent in grooved rolls so as to become a split tube having an external diameter of 6 mm. A wire of coppered unalloyed steel with a diameter of 1.2 mm is wound, in the form of a helix, onto the slit tube with a pitch of 2.2 mm. At the same time, a tape of copper having a width of 7 mm and a thickness of 0.1 mm is placed between the helix and the slit tube. Subsequently, the tube is heated in a soldering furnace through which it passes, preferably continuously. During this process, the melted copper flows, due to capillary action, from the copper tape into the slit of the split tube and closes it. At the same time, and in addition, the helix is soldered onto the tube, and, because of the excess of solder, coppering is achieved that serves as protection from corrosion. In this case, it is particularly advantageous to use, for the rolled-on helix, a galvanically coppered steel wire, i.e., a so-called "stiching-hook wire" ("Heftklammerdraht"), instead of smooth unalloyed steel wire. A tube manufactured in this way is bent, e.g., in the form of a meander and thereby, the evaporator is completed. Even if the essentially simpler manufacturing process is disregarded, the length of the tube is extended by approximately one fourth, due to the particularly favorable heat-emitting surface, while the effect is the same, and that entails a considerable saving of material. Another saving results from the fact that the thickness of the wall of the tube may be reduced inasmuch as, in this case, the tube is more resistant to excess internal pressure in a tangential direction, because of the helices wrapped around it.

EXAMPLE 3

A helical tube that has been manufactured in the manner as described in Example 2, but in which the diameter of the spiral wire amounts to 0.8 mm is used as a cover of a tubular electric heater.

After the heating helices have been inserted centrally, the remaining space in the interior of the tube is filled with magnesium oxide while vibrating. Then, the tube is pressed flat for pre-compression, and bent into a circular shape. The tube bent in this way is inserted into a swage and pressed with a pressure of 5 t per $cm^2$ against the bottom of a "grease-baking device" made of aluminum. During this process, the adjacent helical sections penetrate vertically into the aluminum sheet of the bottom. Thus, the aluminum flows in the axial direction of the tubular heater and is pressed in behind the largest cross section of the adjoining sector of the wire helix. In this way, an anchoring effect is achieved, so that the pressed-on tubular heater cannot be separated from the aluminum bottom, even when a large force is applied.

In the described example, the bottom of the "grease-baking device" has an external diameter of 220 mm; and the ring-shaped tubular heater has a mean diameter of 180 mm and a total length of 450 mm. The casing of the tube consists of unalloyed steel and the thickness of its wall amounts to 0.5 mm. The helical wire also consists of unalloyed steel having a diameter of 0.6 mm, and the helical pitch amounts to 2 mm. The outer diameter of the tube, without taking the helix into account, amounts to 8 mm. Flat-pressing to a thickness of 6.5 mm is performed by a pressing tool having a semi-circular profile. Following the pressing-on with a pressure of 220 t, the surface that is in contact with the aluminum bottom is plane; the tube there has a width of 9 mm.

Change-of-temperature tests within a range of 150° to 250° C. have demonstrated that, up to a load in the contact surface of 80 $W/cm^2$, the temperature difference between the tubular heater and the aluminum bottom remains constant. Consequently, sufficient safety is provided since, in practice, the load in the plane of junction reaches its maximum at approximately 30 $W/cm^2$.

EXAMPLE 4

Panel heaters for electric space heating are equipped in most cases with heating elements having the form of tubular electric heaters bent so as to present the shape of a "U". Those heating elements are located between 2 tinplates constituting the casing and transmit heat to them by way of radiation. Unalloyed steel is used as material for the tubes, due to cost considerations. Such tubes make possible only up to an output of some 500 W per tubular heater, because in the case of higher outputs, the humming noises of the alternating current become so loud that they have an annoying effect. In the case of higher outputs, it is necessary to use tubular heaters with non-magnetic austenitic chrome-nickel steel which are more expensive.

For this purpose, a split tube having an external diameter of 8 mm is made by grooved rolls from an unalloyed steel tape having a thickness of 0.4 mm. A chrome steel wire containing 18% of chromium and having a diameter of 0.3 mm is wound onto the split tube in the shape of a helix with a pitch of 4 mm. At the same time, a copper tape having a width of 2 mm and a thickness of 0.1 mm is inserted between the helix and the split tube. Subsequently, the tube is heated in a soldering furnace through which it passes continuously. During this process, the melted copper flows, due to capillary action, from the copper tape into the slit of the split tube and closes it. Subsequently, the helical wire of chrome steel is wound-off and may then be reused. Chrome steel is not soldered to unalloyed steel when copper solder is used. The product is a casing for a tubular heater in which, due to the interruption of the magnetic flux, the humming noise of the alternating current is considerably less, so that, from a practical point of view, pipes for all outputs of panel heaters can be produced.

EXAMPLE 5

A helical tube is manufactured basically as described in Example 2, but uses helical wire having a diameter of 0.5 mm and a pitch of 3 mm, as well as a width of the copper tape of 5 mm. The tube serves as a conveying tube for brake fluid of automobiles. In a brake system of this type, steel tubes alternate with hoses made of rubber, plastic, or similar materials. At the junction of the tube with the hose, the end of the hose is slid onto the end of the tube and fastened by means of a hose clamp. As has been demonstrated by practical tests, this junction point is absolutely tight, despite the soldered-on helix, and it actually has the advantage over a smooth tube that a pulling-off of the hose from the tube is not possible due to the anchoring effect of the helix, as long as the hose clamp is tightened.

The invention, and its objects and advantageous, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Because methods of forming helical tubes are well known, the present description will be directed in particular to elements forming part of, or cooperating more directly with, the present invention. Elements not specifically shown or described herein are understood to be selectable from those known in the art.

Figure 1:
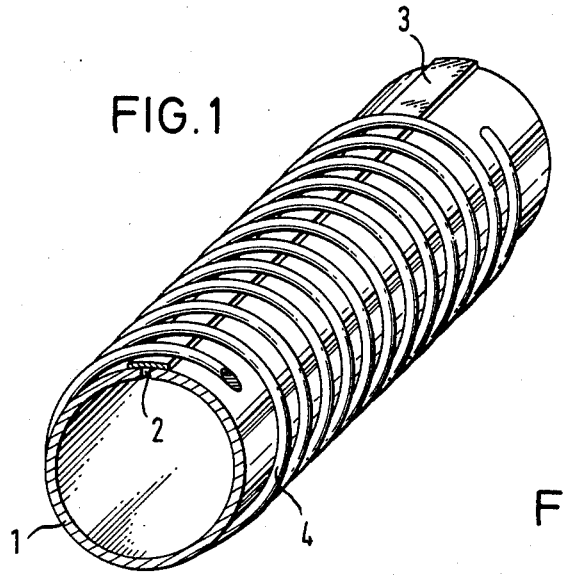
FIG. 1 is a perspective view of a split tube wrapped with a wire helix, before soldering.

In the case of the embodiment of the invention, as shown in FIG. 1, a metal tape 1, e.g., of unalloyed steel, is shaped by grooved rolls so as to form a split tube, generally designated 1'. Near the split 2, a copper tape 3 is placed on the split tube. Then, a wire 4 of coppered unalloyed steel is wound on, in the shape of a helix under initial tension, so that a wire helix, generally designated 5, is formed. Representative dimensions, as calculated for an internal pressure of some 50 atmospheres absolute pressure, are as follows:

Thickness of the wall of the split tube 1'—0.5 mm
Outside diameter of the split tube—6 mm
Diameter of the wire—1.2 mm
Pitch of the copper tape (distance between spirals-)—2.2 mm
Width of the copper tape—7 mm
Thickness of the copper tape—0.1 mm The slit 2 is a capillary slit. In the drawing, it has been shown wider than in reality, for the sake of clarity. When a pipe of this type is heated in a soldering furnace through which it passes, preferably continuously, the copper tape 3 melts. The melted copper flows into the slit 2, because of capillary action, and closes it. In addition, the helix 5 is soldered to the tube. By means of the excess solder, a coppering of the helix, that serves as protection from corrosion, is achieved.

Figure 2:
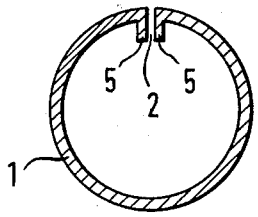
FIG. 2 is a cross section of a modified form of the embodiment of the split tube illustrated in FIG. 1.

In the case of the embodiment of the invention illustrated in FIG. 2, the marginal areas 6 of the metal tape 21 are bent vertically. The opposing surfaces of the marginal areas 6 are pressed upon one another by means of a wire helix (not shown), which is similar to helix 5 in FIG. 1. In this manner, a deeper split 22 is formed, with proportionally increased solidity of the seam junction.

Figure 3:
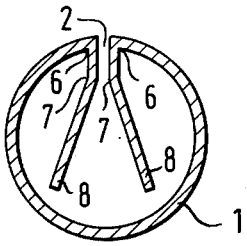
FIG. 3 is a cross section of another modified form of the embodiment of the split tube illustrated in FIG. 1.

When an improvement of the heat transmission, e.g., from a medium flowing inside the tube to the outer surface of the tube is desired, then it is possible, as shown in FIG. 3, to use a metal tape 31 that is considerably wider than the diameter of the tube to be manufactured. The marginal areas of the tube are bent twice, at 36 and 37, so that on the one hand, a slit 32 of the desired depth is achieved, while on the other hand, tongues 38 are formed that extend far inside the tube. By means of the tongues 38, the flowing medium is kept within a laminary flow and, thereby, turbulance is prevented. The heat transmission to the outside of this tube will be increased considerably.

The form of embodiment of the invention as shown in FIG. 3 is also particularly advantageous in fields of application in which heat is to be transmitted from the outer surface of the tube toward the inside, e.g., when a fluid with poor heat conduction is conveyed inside the tube to be heated. In the case of temperature measuring or adjusting devices, the speed of response can be improved considerably by the tongues 38 that project inside the tube. As a matter of course, the cooling of flowing media is also improved considerably.

Figure 4:
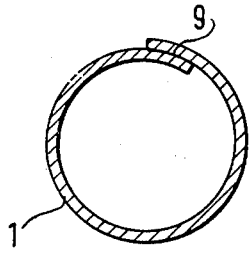
FIG. 4 is a cross section of a third modified form of the embodiment of the split tube illustrated in FIG. 1.

In the case of the embodiment of the invention, as shown in FIG. 4, the metal tape 41 is bent in such a way that an overlap is formed at 49. The inner marginal area has—now as before—a tendency toward being upward to some extent. The outer marginal area is pressed on the inner marginal area by a helix (not shown) similar to helix 5 of FIG. 1. In this manner, a well-defined capillary slit will also be formed.

Consequently, tubes of a high quality may be achieved by the method in accordance with the invention. The wire helix, or tape helix, ensures that no modifications—not even within a range of far less than 1/10 mm—can occur, due to the action of heat during the soldering process, so that an extremely exact uniform seam will be achieved.

In one embodiment of the method invented by applicant, the heating of the wrapped metal tube is accomplished in two steps. The first step uses high-frequency heating and the second step uses radiation heating with a protective gas surrounding the members being heated. This two stage heating reduces the possible weakening of the metal tube by the heating step.

Further, the solder used with the method invented by applicant can be applied either as a separate piece of solder, as a coating on the helical wire, or as a coating on the metal tape. Also, any combination of the preceding can be used with applicant's method.

The invention has been described in detail with particular reference to preferred embodiments thereof, but it will be understood that variations and modifications can be effected within the spirit and scope of the invention.

I claim:

1. Method for manufacturing a composite structure comprising:

forming a thin-walled tube by:

passing longitudinally-extending metal tape through forming tools, the forming tools bending the metal tape in such manner that a tube is formed with lateral edges of the metal tape being spaced from each other to define an opening, the lateral edges being bent at right angles to the plane of the metal tape and extending towards the center of the tube;

placing a continuous strip of solder material having a width greater than the width of said opening on a predetermined portion of an exterior surface of said metal tube so that the strip covers the opening defined by said edges;

wrapping a continuous member in a helical manner around said metal tube and said continuous strip so that said continuous strip is held on said predetermined portion; and heating said tube, said strip and said member so that said member melts and flows by capillary action into said opening thereby forming the thin-walled tube;

slipping the end of a hose made of plastic or elastic material over the end of the tube wrapped with the continuous member; and pressing the plastic or elastic material into the helix defined by the continuous member.

2. Method in accordance with claim 1 wherein the pressing is done by a hose clamp.

3. Method for manufacturing a composite structure comprising:

forming a thin-walled tube by:

passing longitudinally-extending metal tape through forming tools, the forming tools bending the metal tape in such manner that a tube is formed with lateral edges of the metal tape being spaced from each other to define an opening;

placing a continuous strip of solder material having a width greater than the width of said opening on a predetermined portion of an exterior surface of said metal tube so that the strip covers the opening defined by said edges;

wrapping a continuous member in a helical manner around said metal tube and said continuous strip so that said continuous strip is held on said predetermined portion; and heating said tube, said strip and said member so that said member melts and flows by capillary action into said opening thereby forming the thin-walled tube;

slipping the end of a hose made of plastic or elastic material over the end of the tube wrapped with the continuous member; and pressing the plastic or elastic material into the helix defined by the continuous member.

4. Method in accordance with claim 3 wherein the pressing is done by a hose clamp.

* * * * *